US005909850A

United States Patent [19]

Cavasin et al.

[11] Patent Number: 5,909,850

[45] Date of Patent: Jun. 8, 1999

[54] FASTENING DEVICE PARTICULARLY FOR SPORTS SHOES

[75] Inventors: Giuseppe Cavasin, Montebelluna; Giovanni Dal Din, Caerano San Marco, both of Italy

[73] Assignee: Roces S.R.L., Italy

[21] Appl. No.: 09/014,200

[22] Filed: Jan. 28, 1998

[30] Foreign Application Priority Data

Apr. 2, 1997 [IT] Italy ..... MI970068 U

[51] Int. Cl.[6] ..... A43C 11/14

[52] U.S. Cl. ..... 24/71 SK; 24/70 SK

[58] Field of Search ..... 24/71 SK, 70 SK, 24/68 SK, 89 SK, 68 J, 68 E, 70 J, 69 J

[56] References Cited

U.S. PATENT DOCUMENTS 3,678,540 7/1972 Graup ..... 24/70 SK 5,172,454 12/1992 Martignaga ..... 24/71 SK X 5,501,023 3/1996 Miotto ..... 24/71 SK X

*Primary Examiner*—Anthony Knight

*Assistant Examiner*—Robert J. Sandy

*Attorney, Agent, or Firm*—R. Neil Sudol; Henry D. Coleman

[57] ABSTRACT

A fastening device particularly usable for sports shoes, such as roller skates or ice skates or ski boots, includes a base (5) which is associated with a first flap (2) of the shoe and from which there protrude two shoulders (**6*a*, 6*b*) for the pivoting of a lever arm between which a support for a pawl (14) for selective engagement with a toothed tab (4) is pivoted. The support has at least one lateral protrusion (22) which interacts with a hole (25) formed on shoulder (6*a***) of the base; this allows to achieve easy snap-closing and snap-opening of the lever arm.

6 Claims, 2 Drawing Sheets

FASTENING DEVICE PARTICULARLY FOR SPORTS SHOES

BACKGROUND OF THE INVENTION

1. Field of the invention

The present invention relates to a fastening device which is particularly usable for sports shoes, such as roller skates or ice skates or ski boots.

2. Description of the Prior Art

It is known to fasten the flaps of shoes by using fastening levers, associated with a first flap to be fastened, which allow one, for example, to place tension on a toothed strap which is rigidly coupled to the other flap of the shoe.

The problems that arise in the production of these devices mainly consist in having to perform optimum tensioning of the strap and to allow quick and easy release of the strap.

Italian Utility model application No. 61949 B/78, shows a partial solution to these problems: it relates to a lever-type closure device for ski boots which essentially includes a lever which is rigidly coupled to a flap of the upper and a substantially rigid toothed strap for connecting the flaps, which is pulled by the lever.

In this solution, the strap is rigidly coupled, at one end, to a flap of the upper and engages a stop ratchet system which is articulated to the closure lever.

This device, however, has drawbacks, such as the fact that the ratchet system can be actuated only once the lever has been opened, thus forcing the user to apply a considerable effort in order to overcome the degree of fastening set on the toothed strap.

Furthermore, any accidental impact of the free end of the lever with the snow or ground may entail accidental openings of the lever and a consequent loosening of the toothed strap, with a consequent unfastening of the flaps.

Italian Utility model application No. 59401B/90, discloses a device for fastening a first flap and a second flap of a shoe; the device includes a first base which is rigidly coupled to the first flap and from which there protrude two pivoting shoulders for a lever arm which has a pivot for a support provided with a ratchet system for engaging a toothed tab. The support and the ratchet system have a first longitudinal slot and a second longitudinal slot which act as a seat for the pivot, which selectively interacts with a stop means formed on the shoulders.

This device has the drawback that optimum fastening is achieved only when the strap is tensioned so as to temporarily accommodate the ends of the pivot in the stop means formed on the front perimetric edge of the pair of shoulders.

SUMMARY OF THE INVENTION

The aim of the present invention is to overcome the above drawbacks, providing a device which allows one to quickly and easily fasten and unfasten the flaps of a shoe.

An important object of the present invention is to provide a device which can be fastened regardless of whether the strap to be tensioned is perfectly tensioned.

A further object of the present invention is to provide a device which has a lever arm which ensures optimum fastening, once it has been rotated fully into the closed condition, regardless of the intensity of the forces applied to the strap.

Another important object of the present invention is to provide a fastening device which is not subject to accidental openings caused by any contact of the lever arm with the snow.

Yet another object of the present invention is to provide a device which is reliable and safe in use and has very low manufacturing costs which allow its widespread diffusion.

This aim, these objects and others which will become apparent from the description that follows are achieved by a fastening device claimed in the appended claims. Other objects will become apparent from the description that follows, which is to be considered together with the accompanying drawings, which illustrate, by way of non-limitative example, a particular embodiment, and wherein:

DESCRIPTION OF THE PREFERRED EMBODIMENTS OF THE INVENTION

Figure 1:
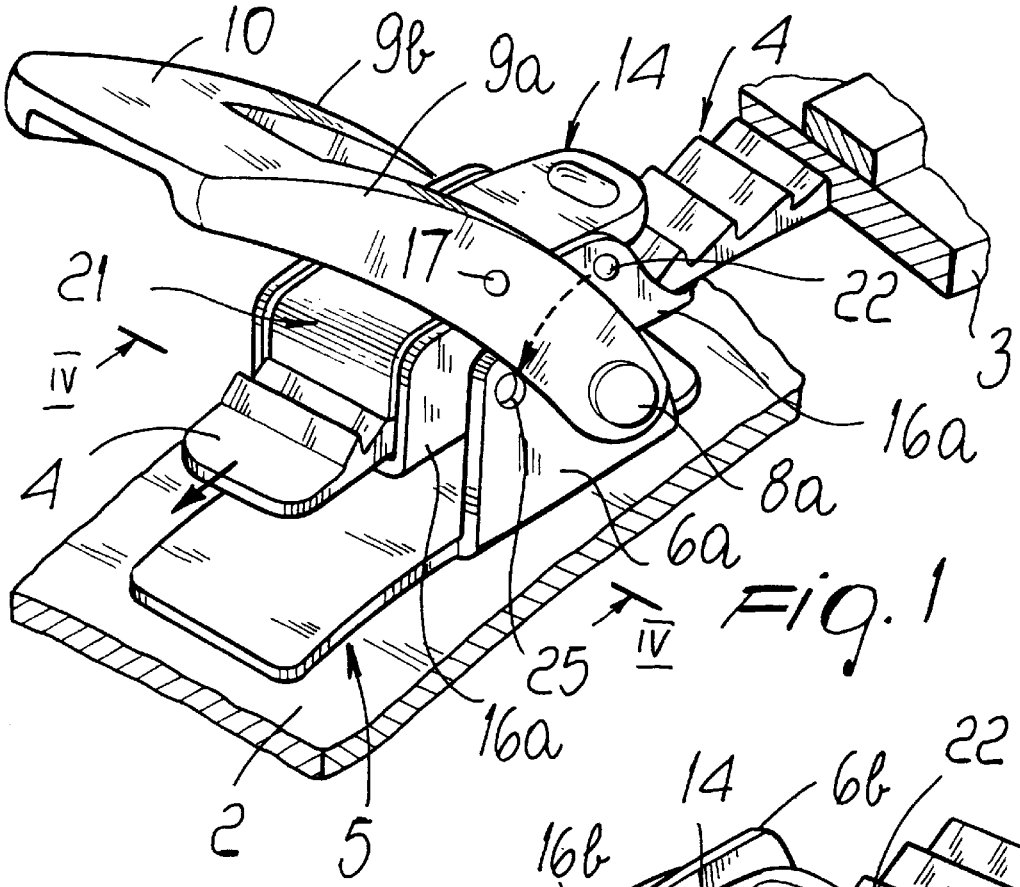
FIG. 1 is a lateral perspective view of a fastening device for footwear with a lever arm in an intermediate position.
Figure 3:
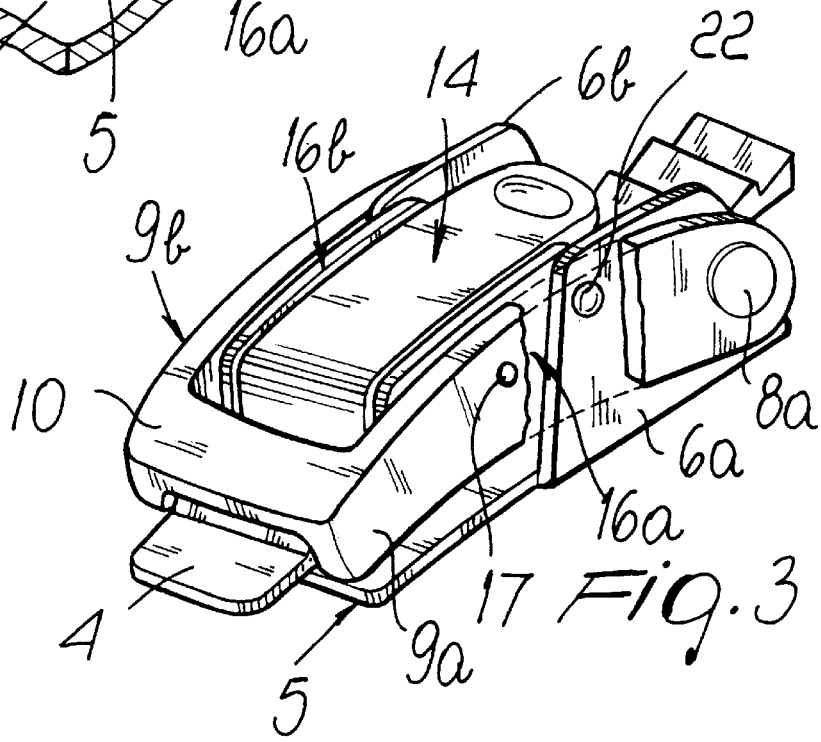
FIG. 3 is a perspective view of the device, similar to FIG. 1, in the condition in which the lever arm is closed.
Figure 4:
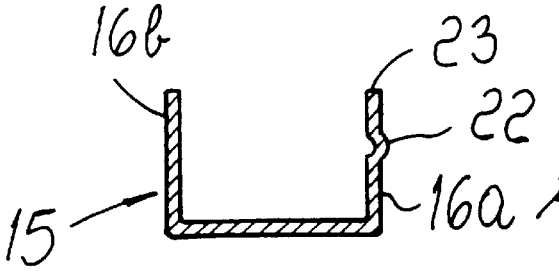
FIG. 4 is a sectional partial view, according to the line IV—IV of FIG. 1, transversely to a base element and at a lateral protrusion.
Figure 2:
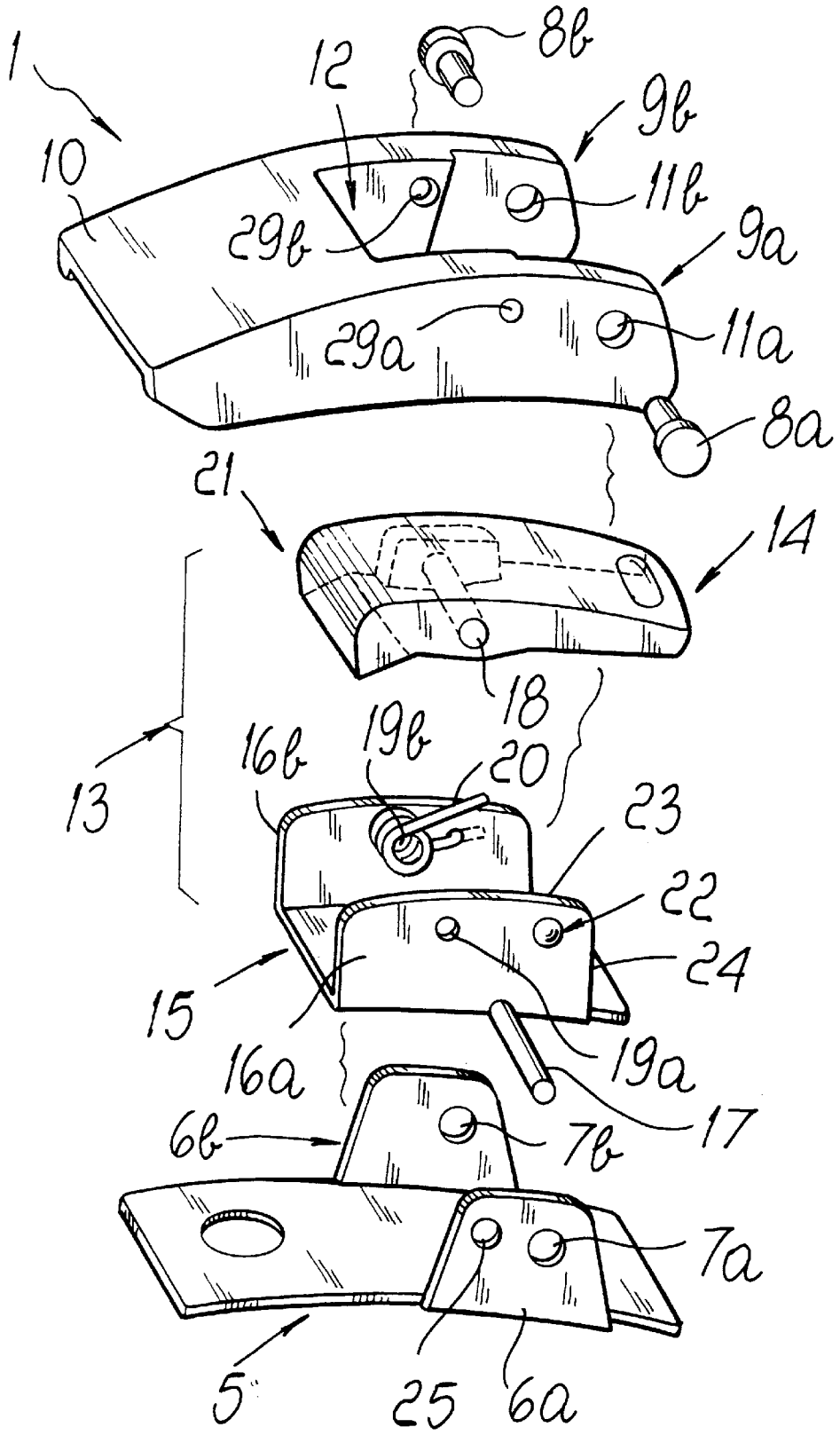
FIG. 2 is an exploded perspective view of the device.

With reference to the above figures, and bearing in mind that the figures exemplify a particular embodiment and are in variable scales and that in the figures individual reference numerals designate identical or equivalent parts, the numeral 1 designates the fastening device, which is particularly usable for fastening a first flap and/or a second flap, designated by the reference numerals 2 and 3, of an upper and/or shell of a sports shoe, for example for skating or skiing.

The fastening device 1 interacts with a toothed tab 4 which is associable with the second flap 3 of the shoe.

The fastening device 1 is constituted by a first base 5 which is preferably rectangular and is rigidly coupled to the first flap 2 by means of screws or rivets.

Two shoulders 6*a* and 6*b* protrude from the first base 5 at the longitudinal sides; each shoulder has a first pair of holes 7*a* and 7*b* which have the same axis, and two pivots 8*a* and 8*b* can be positioned at the holes so as to pivot the ends of wings 9*a* and 9*b*, of a U-shaped lever arm 10, relative to first base 5.

Pivots 8*a* and 8*b* are also inserted into respective ones of a second pair of holes 11*a* and 11*b*, both of which are formed at the same axis that lies transversely to the ends of wings 9*a* and 9*b* of lever arm 10.

A seat 12 for temporarily positioning a pawl means 13 comprising a pawl 14 is formed between wings 9*a* and 9*b*.

The pawl means 13 comprises a support 15 constituted by a U-shaped base from which two walls or shoulders 16*a* and 16*b* protrude laterally. Pawl 14 is pivoted between the walls by means of a pivot pin 17 which passes inside a hole 18, which is formed transversely to the pawl, inside a third pair of holes 19*a* and 19*b*, formed on the pair of walls 16*a* and 16*b*, and inside a fourth pair of holes 29*a* and 29*b* formed on wings 9*a* and 9*b* of the lever arm.

A spring 20 is arranged coaxially to pivot 17; one of the springs ends interacts with pawl 14, while the other end is associated with one of the two walls 16*a* and 16*b*.

Spring 20 biases the end of pawl 14 to engage, with a ratcheting action, the underlying toothed tab 4 during the insertion thereof and prevents its extraction.

Support 15 has at least one lateral protrusion 22, such as a stud or ridge or any member that protrudes laterally from at least one of the two walls 16*a* and 16*b*.

Advantageously, the protrusion 23 is provided proximate to the upper edge 23 and the rear edge 24 of the chosen wall 16*a* and/or 16*b*.

The protrusion interacts, when lever arm 10 closes, with a complementarily shaped stop means or seat 25 formed on the pair of shoulders 6*a* and 6*b*.

The stop means is constituted by a hole or a cavity or a seat which is shaped complementarily to the stud which fits therein with a snap action during the last part of the rotation applied to the lever arm during closure.

The operation of the device according to the invention is in fact such that once the strap has been associated with pawl 14 it is sufficient to rotate the lever arm so as to apply tension to the strap to the point where the insertion of the protrusion or stud 22 in the stop means 25 is forced with a snap action, so as to achieve stable locking and avoid possible openings caused by accidental impacts.

A simple lifting of the lever arm uncouples the stud from the stop means and allows one to unfasten the flaps 2 and 3.

It has thus been shown that the device has achieved the intended aim and therefore all the stated objects, since it allows to quickly and easily fasten and unfasten the flaps of a shoe and to achieve the fastening regardless of whether the strap is perfectly tensioned or possibly loose.

The materials and the configuration or dimensions of the individual components of the device may of course be the most pertinent and the most disparate according to the specific requirements.

We claim:

1. A fastening device for a shoe comprising at least a first member and a second member to be fastened together, said device comprising:

a base connected to said first member, said base including a pair of shoulders;

a toothed member connected to said second member;

a lever arm pivoted to said shoulders;

a pawl means coupled with said lever arm and adapted to selectively engage at least one tooth of said toothed member, said pawl means including a pawl and a support, said pawl being pivoted to said support, said support being pivoted to said lever arm; and an engagement means provided on said pawl means and on said base and adapted to firmly and releasably lock said pawl means to said base, said engagement means including at least one protrusion formed on said support and further including at least one seat formed on at least one of said shoulders, said protrusion coacting with said seat to releasably lock said pawl means to said base.

2. Device according to claim 1, wherein each of said shoulders has a first pair of holes having the same axis, a pair of pivots being arranged at said holes for pivoting ends of wings of said lever arm which is U-shaped, said pair of pivots also being inserted in a second pair of holes formed at said axis which lies transversely to said ends of said wings, a seat being formed between said wings for temporarily positioning said support which is U-shaped and has two lateral walls, said pawl being pivoted between said two lateral walls by a pivot which passes through a hole which is formed in said pawl transversely to said pawl and to a third pair of holes formed in said lateral walls and a fourth pair of holes formed on said wings of said lever arm, a spring being arranged coaxially to said first pivot, a first end of said spring interacting with said pawl, a second end of said spring being associated with one of said two walls.

3. Device according to claim 2, wherein said at least one protrusion is formed on a lateral surface of at least one of said lateral walls of said support, said at least one protrusion being formed proximate to an end of said base at which said toothed member is inserted.

4. Device according to claim 3, wherein said at least one seat is constituted by a hole provided on one of said shoulders proximate to an end of said base opposite the end thereof at which said toothed member is inserted.

5. Device according to claim 1, wherein said lever arm is U-shaped and has a pair of substantially parallel wings having respective ends, said shoulders having a first pair of holes and said wings having a second pair of holes, all of said holes having the same axis which is oriented transversely to said wings, a pair of pivots being arranged at said holes for pivotally coupling said ends of said wings to said shoulders, said support being U-shaped and having two lateral walls, a seat being formed between said wings for receiving said support, said pawl being pivotably disposed between said two lateral walls, said pawl having a hole oriented transversely to said pawl, said lateral walls having a third pair of holes and said wings having a fourth pair of holes, a pivot passing through said hole in said pawl, said third pair of holes and said fourth pair of holes, a spring being arranged coaxially to said first pivot to spring bias said pawl with respect to one of said two lateral walls.

6. Device according to claim 5, wherein said protrusion is formed proximate to an end of said support at which said toothed member is inserted, said at least one seat being formed proximate to an end of said base opposite an end thereof at which said toothed member is inserted.

* * * * *